US006553886B1

(12) United States Patent
Mance

(10) Patent No.: US 6,553,886 B1
(45) Date of Patent: Apr. 29, 2003

(54) AUTOMATIC RETRACTION SYSTEM FOR RING ROLLER

(76) Inventor: Vitomir Mance, 33 Watson Road South, Guelph, Ontario (CA), N1H 4P9

( * ) Notice: Subject to any disclaimer, the term of this patent is extended or adjusted under 35 U.S.C. 154(b) by 29 days.

(21) Appl. No.: 09/734,025

(22) Filed: Dec. 12, 2000

Related U.S. Application Data

(60) Provisional application No. 60/209,953, filed on Jun. 8, 2000.

(51) Int. Cl.[7] ..... B26D 3/28; C14B 1/14

(52) U.S. Cl. ..... 83/871; 83/435; 83/938; 69/9; 69/10; 69/13

(58) Field of Search ..... 83/871, 874, DIG. 1, 83/168, 698.61, 424, 699.61, 435, 936, 938, 698.41, 698.51; 69/1, 2, 9, 9.1, 9.3, 11, 13, 38, 21.5, 37, 42, 43, 45, 10, 36

(56) References Cited

U.S. PATENT DOCUMENTS

| | | | | | |
|---|---|---|---|---|---|
| 1,731,132 | A | * | 10/1929 | Hendry et al. | 83/874 |
| 2,154,115 | A | * | 4/1939 | Stehling | 69/10 |
| 3,186,195 | A | * | 6/1965 | Braun | 69/10 |
| 3,393,538 | A | * | 7/1968 | Mercier | 69/10 |
| 3,570,348 | A | * | 3/1971 | Hallden | 83/342 |
| 3,741,105 | A | * | 6/1973 | Beasley | 99/589 |
| 4,244,201 | A | * | 1/1981 | Repetto | 69/9 |
| 4,253,318 | A | * | 3/1981 | Repetto | 69/9.1 |
| 4,549,416 | A | * | 10/1985 | Repetto | 69/10 |
| 6,142,053 | A | * | 11/2000 | Denney et al. | 83/874 |
| 6,434,978 | B1 | * | 8/2002 | Mance | 69/9 |

FOREIGN PATENT DOCUMENTS

| | | |
|---|---|---|
| EP | 32 04 182 A1 | 10/1983 |
| EP | 0 870 581 A2 | 10/1998 |

OTHER PUBLICATIONS

English abstract from ESPACENET of US 5238234.
English abstract from ESPACENET of DE 3327458.
English abstract from ESPACENET of US 4617809.
English abstract from ESPACENET of EP 0078528.
English abstract from ESPACENET of EP 0093353.
English abstract from ESPACENET of FR 2555928.
English abstract from ESPACENET of US 4055059.
English abstract from ESPACENET of FR 2543475.
English abstract from ESPACENET of FR 2518919.
English abstract from ESPACENET of FR 2511923.
English abstract from ESPACENET of FR 2512462.
English abstract from ESPACENET of FR 2518574.
English abstract from ESPACENET of DE 3422723.
English abstract from ESPACENET of DE 3418105.

* cited by examiner

*Primary Examiner*—Boyer D. Ashley
(74) *Attorney, Agent, or Firm*—R. Craig Armstrong; Bordan Ladner Gervais LLP

(57) ABSTRACT

A hide splitting machine according to the invention has two pivot arms, mounted on modified journals at each end of a rubber roller, that are connected to two ring roller swivel arms attached to each end of the ring roller. The ring roller swivel arms connected to the pivot arms allow constant radial distance movement of the ring roller along the circumference of the rubber roller. Therefore, the ring roller can be retracted or moved away automatically, without possibility of mechanical damage, from the razor sharp band knife and ring jaw insert edge. The automatic retraction of the ring roller a preset distance allows splitting machine operators to easily access the ring jaw insert for safe, quick and efficient manual cleaning of the ring jaw insert edge. The automatic retraction of the ring roller further eliminates physical handling and/or manual removal of the ring roller from the splitting machine during the ring jaw insert edge cleaning process.

18 Claims, 11 Drawing Sheets

AUTOMATIC RETRACTION SYSTEM FOR RING ROLLER

REFERENCE TO RELATED APPLICATION

This is a formal application based on and claiming the benefit of provisional application Ser. No. 60/209,953, filed Jun. 8, 2000.

BACKGROUND OF THE INVENTION

1. Field of the Invention

This invention relates to leather splitting equipment for animal hides, and especially to an automatic retraction system for a ring roller to facilitate cleansing of the ring jaw insert(s) via automatic retraction of the ring roller.

2. Description of the Prior Art

FIG. 1 is a cross-sectional view of a typical band knife splitting machine 1. The hide 3 to be split is laid out manually on the infeed table 2 and is fed towards the rotating rollers, which in turn grip the hide and lead it towards the rotating band knife 4. The vertical gap between the upper feed roller 5—or "gauge roller"—and the knife edge determines the thickness of the top split 7. This relationship implies that the top split ("grain") must have a uniform thickness while the "flesh" split 8 issuing from below the knife edge will exhibit those differences in hide thickness that are determined by nature.

In order to achieve uniform grain thickness the lower feed roller 6—or "ring roller" —has to have a resilient mounting and be capable of deviating from the straight line of its rotation axis. The ring roller, composed of a set of individual section rings arranged on a shaft, rests on the rubber roller 9.

The vertical surface of the scraper plate 10—or "ring jaw plate"—ensures that the section rings can only give way at right angles to the knife edge. A replaceable insert 11 with sharp beveled edge installed on the tip of the ring jaw plate is designed to scrape off the flesh split from the ring roller and prevent the flesh split from 'wrapping around' the ring roller.

The flesh and grease particles scraped off the flesh side of hide during normal splitting production accumulate at point of contact between the ring jaw insert edge and ring roller (FIG. 2). However, the accumulation of this debris, including flesh and grease particles, interferes with proper centerline position of ring roller with gauge roller. Flesh and grease particle accumulation at the ring jaw insert edge causes individual section rings to deviate from their center of rotation axis and forces the individual section rings upwards into the traveling band knife. Therefore, the debris at the ring jaw insert edge must be removed periodically to maintain splitting accuracy.

Splitting machine operators can successfully remove debris by reversing ring roller rotation (FIG. 3). The ring roller rotating in the opposite direction forces loose flesh and grease particles away from the point of contact between the ring jaw insert edge and ring roller. The ring roller moves into proper working position and rotates smoothly when all loose debris is dislodged from the ring jaw insert edge.

Unfortunately, sufficient removal of debris from the ring jaw insert edge via reversal of ring roller rotation often proves unsuccessful (FIG. 4). In such cases, splitting machine operators stop production and turn off the splitting machine feeding system. For safety purposes, the operators stop band knife rotation and also retract the band knife. The operators retract the splitting machine infeed table to expose the entire ring roller (FIG. 5). The operators then remove the ring roller from the splitting machine to gain access to the ring jaw insert edge. Two or three operators remove the ring roller to prevent deformation and excessive bending of the ring roller shaft. Since the ring roller is situated in an area of very limited and hazardous working space—directly in front of the razor sharp band knife edge (FIG. 6), which wraps around a first pulley 12 and a second pulley 13—operators frequently use safety hooks 14 to pull the ring roller out from the splitting machine. The machine operators clean the exposed ring jaw insert edge with a tool 15 made from wood or plastic material (FIGS. 7 and 8) and then manually reinstall the complete ring roller.

Splitting machine operators and maintenance personnel are exposed to a specific personal safety hazard when manually removing and reinstalling the ring roller: hands and fingers always come into close distance with the razor sharp traveling band knife. Personal safety is compromised further by existing working conditions:

1) wet and greasy floor space 2) wet and greasy equipment and machinery 3) wet and greasy hides for splitting The machine operator can lose physical balance in this wet and greasy working environment. Therefore, during ring roller removal or reinstallation, the machine operator is exposed to great risk of personal physical harm via accidental contact with the razor sharp traveling band knife.

The personal safety of splitting machine operators is further compromised in high production working environments—i.e. splitting 200 to 300 hides per hour. To meet these stringent production requirements splitting machine operators must minimize the total time required to properly pull out the ring roller, clean the ring jaw insert edge and correctly reinstall the ring roller.

Splitting machine operators are usually not certified mechanics or engineers, having extra training in mechanical or engineering matters. Therefore, the ring roller removal and reinstallation procedure also possibly increases the possibility of mechanical damage to the ring roller.

SUMMARY OF THE INVENTION

In view of the preceding, it is an object of the invention to provide a hide splitting machine having a system for automated retraction of the ring roller assembly.

The ideal system for retracting the ring roller assembly has the following features:

1. Facilitates access to ring jaw insert edge.
2. Minimizes cleaning time of ring jaw insert edge to maximize frequency of debris removal from ring jaw insert edge.
3. Minimizes risk of personal injury.
4. Minimizes risk of ring roller mechanical damage.
5. Minimizes machine operator's required level of technical expertise.

In the invention, a hide splitting machine is used, the machine comprising an in-feed table, a ring roller, a rubber roller to support said ring roller, a gauge roller and a traveling band knife. The machine is arranged to split hides fed into a gap created between the ring roller and the gauge roller. The ring roller is rotatably held in a pair of swivel arms, the swivel arms being anchored at outer ends of a first pivot arm and a second pivot arm. The first pivot arm and the second pivot arm are arranged co-axially with the rubber roller, with the first pivot arm arranged at one end of the rubber roller and the second pivot arm being arranged at the opposite end of the rubber roller. The first pivot arm is pivotable using a first biasing means and the second pivot arm is pivotable using a second biasing means. When said in-feed table is swung away from the rubber roller, the first and second pivoting means, respectively, can be pivoted away from the gauge roller moving the ring roller also away from the gauge roller.

Advantageously, the first and second biasing means comprise linear actuators, for example pneumatic cylinders, hydraulic cylinders, long-throw solenoids, gear-driven actuators or mechanical linkage systems.

DETAILED DESCRIPTION OF THE PREFERRED EMBODIMENTS

Figure 1:
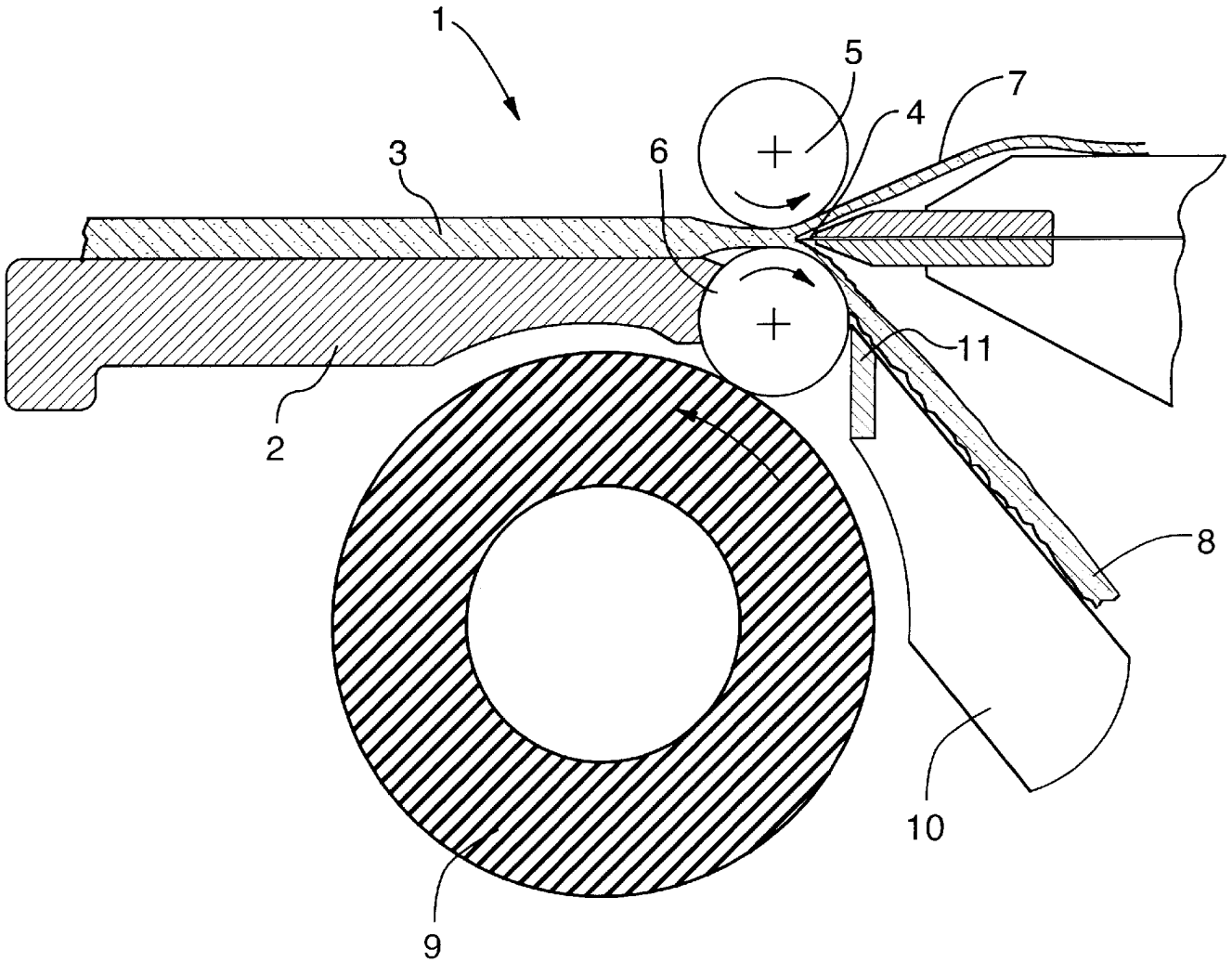
FIG.1 (Prior Art)
FIG. 1 is a schematic sectioned end view of a hide splitting machine according to Prior Art, showing a hide being split.
Figure 2:
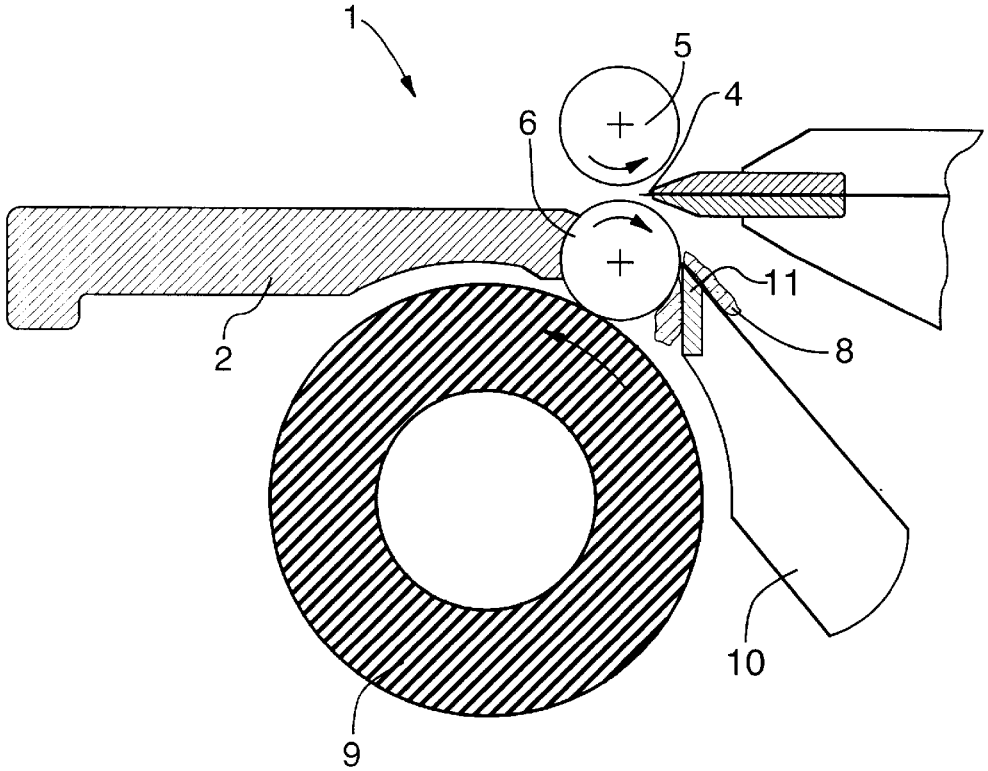
FIG.2 (Prior Art)
FIG. 2 is a schematic sectioned end view of a hide splitting machine according to Prior Art, showing accumulation of flesh and grease around the ring jaw insert edge.
Figure 3:
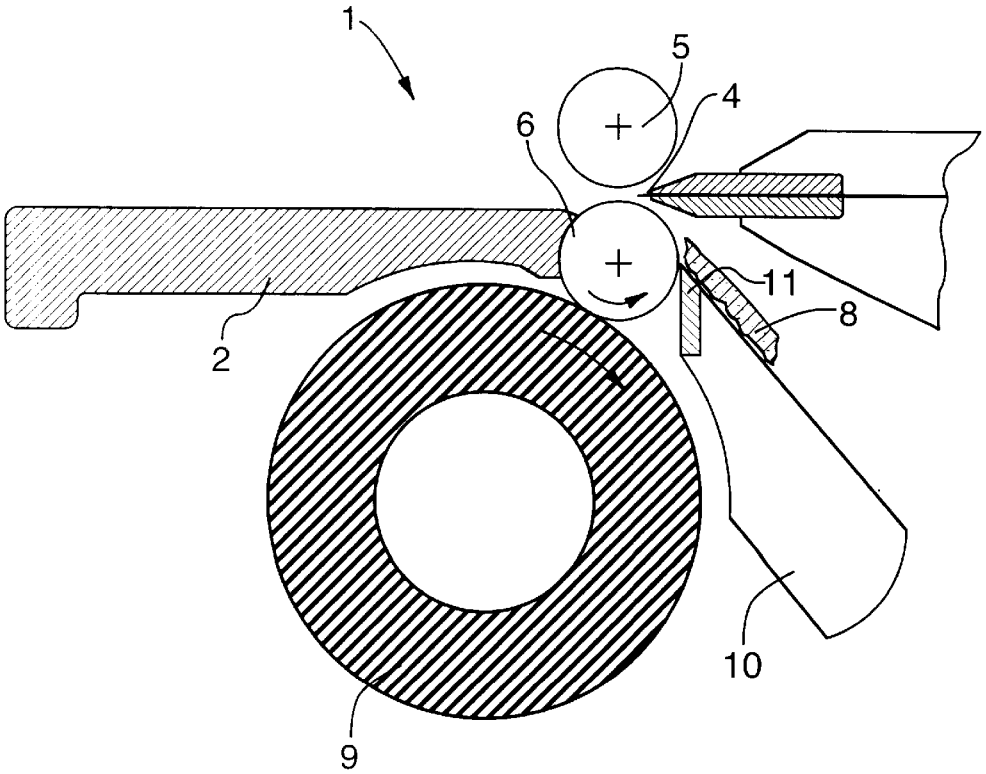
FIG.3 (Prior Art)
FIG. 3 is a schematic sectioned end view of a hide splitting machine according to Prior Art, showing reversal of the ring roller to remove flesh and grease around the ring jaw insert edge.
Figure 4:
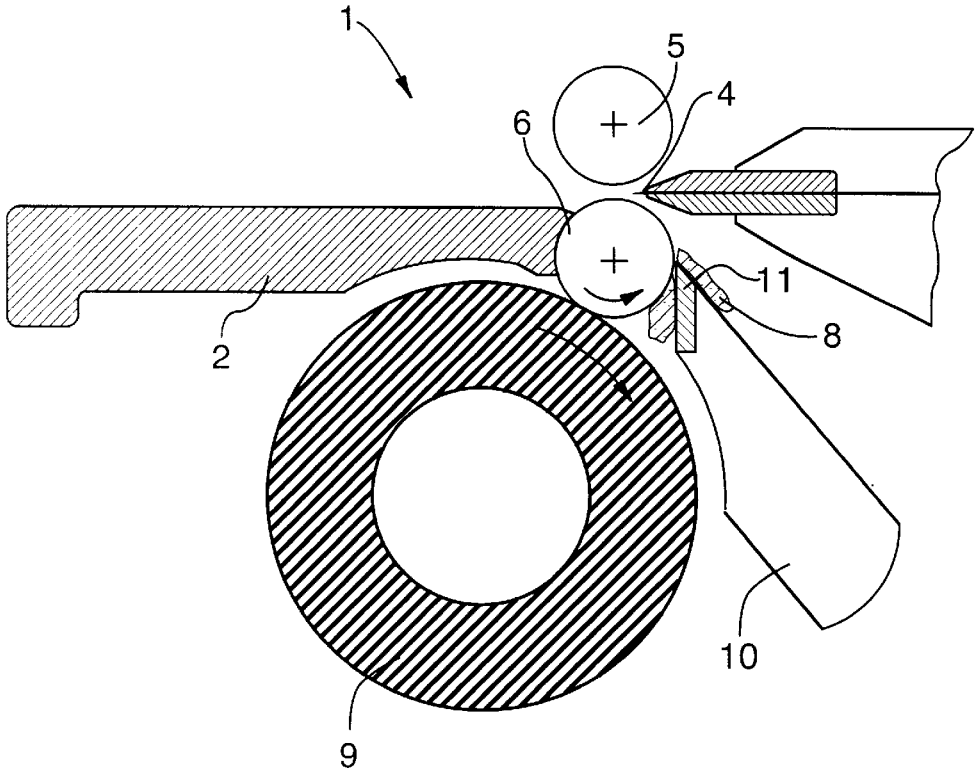
FIG.4 (Prior Art)
FIG. 4 is a schematic sectioned end view of a hide splitting machine according to Prior Art, showing reversal of the ring roller to unsuccessfully remove flesh and grease around the ring jaw insert edge.
Figure 5:
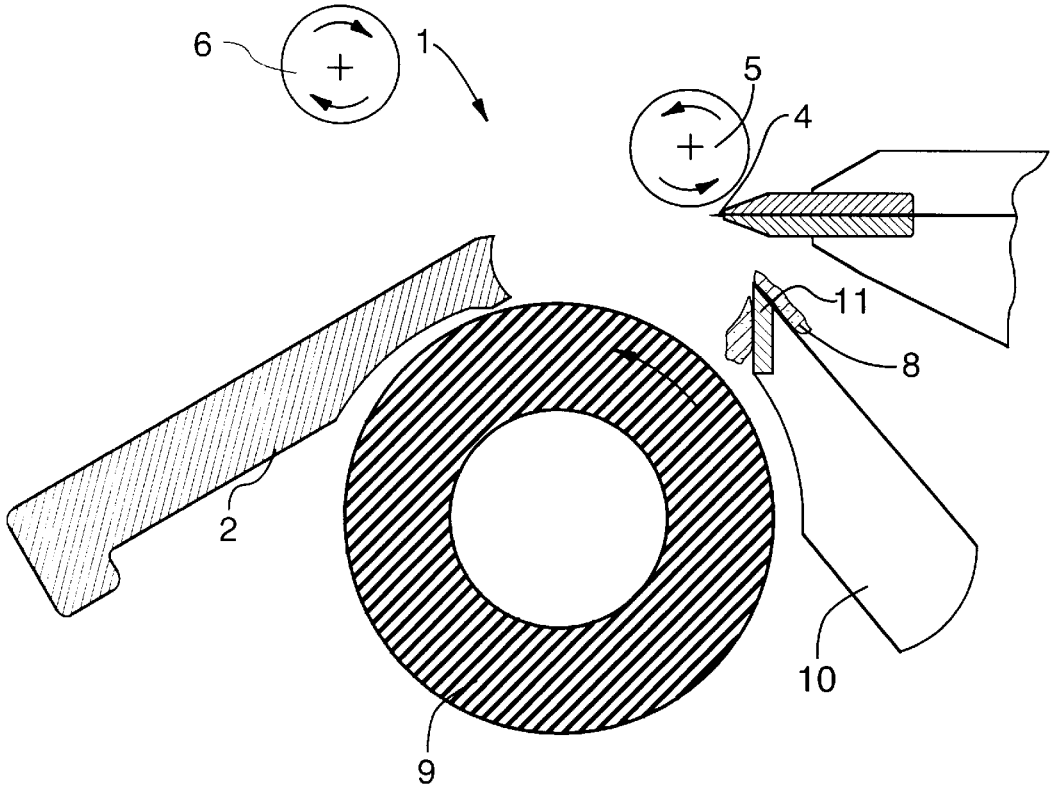
FIG.5 (Prior Art)
FIG. 5 is a schematic sectioned end view of a hide splitting machine according to Prior Art, showing removal of the ring roller to manually remove flesh and grease around the ring jaw insert edge.
Figure 6:
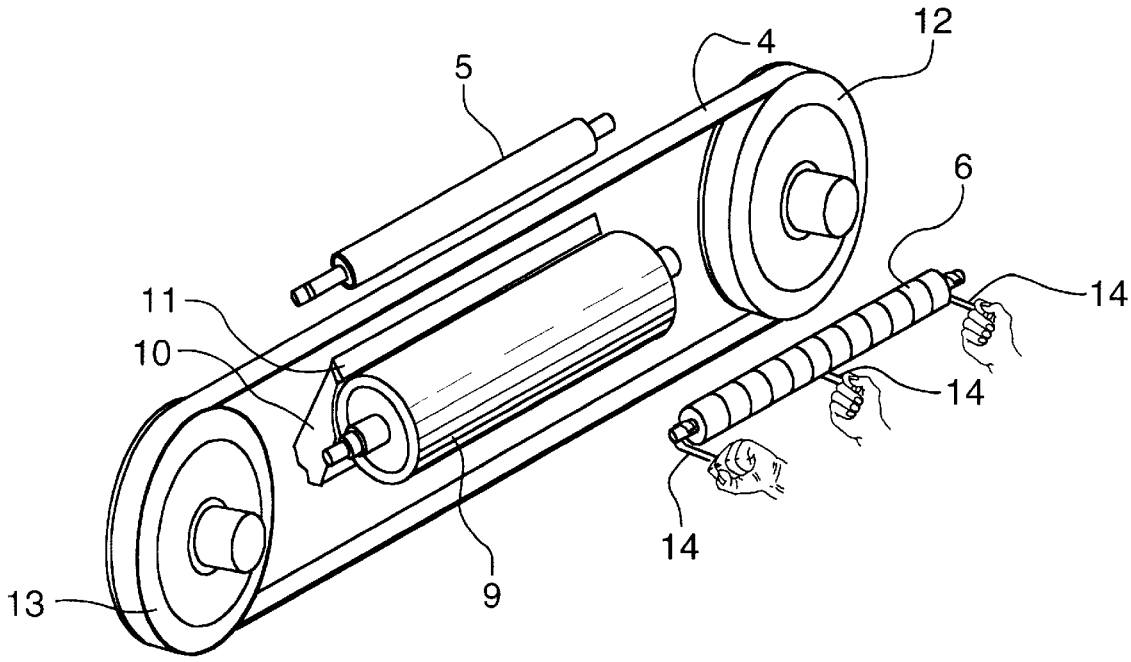
FIG.6 (Prior Art)
FIG. 6 is a schematic perspective elevational view of a p art of a hide splitting machine according to Prior Art, showing manual removal of the ring roller.
Figure 7:
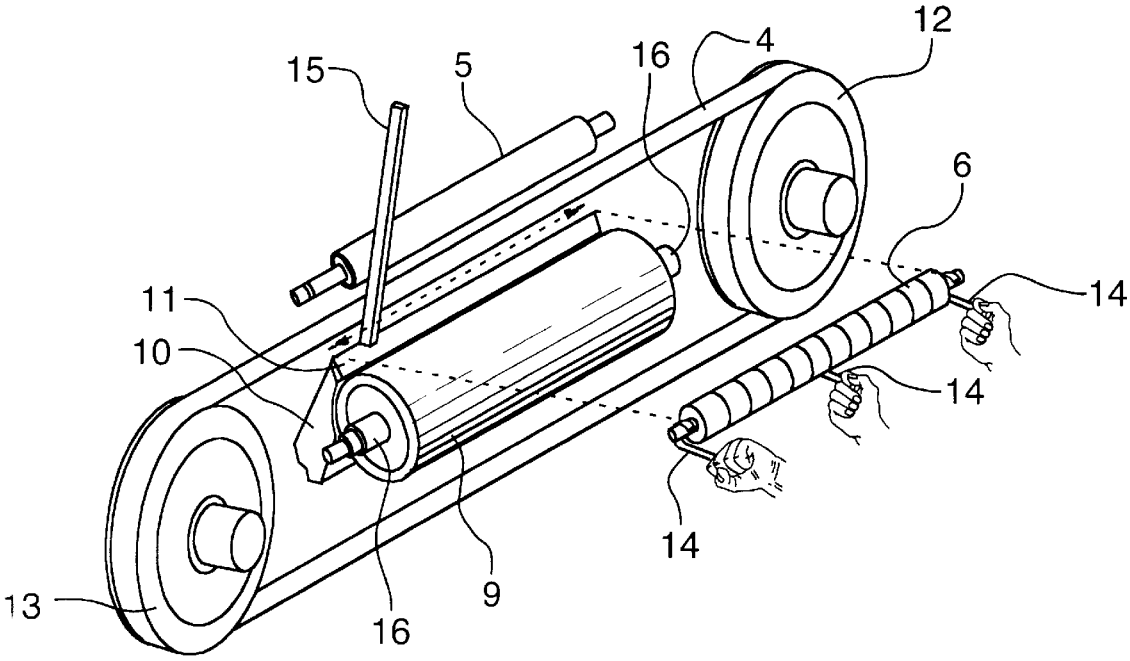
FIG.7 (Prior Art)
FIG. 7 is a schematic perspective end view of a hide splitting machine according to Prior Art, showing manual cleaning of the exposed ring jaw insert edge with a tool made from wood or plastic material followed by manually reinstallation of the complete ring roller.
Figure 9:
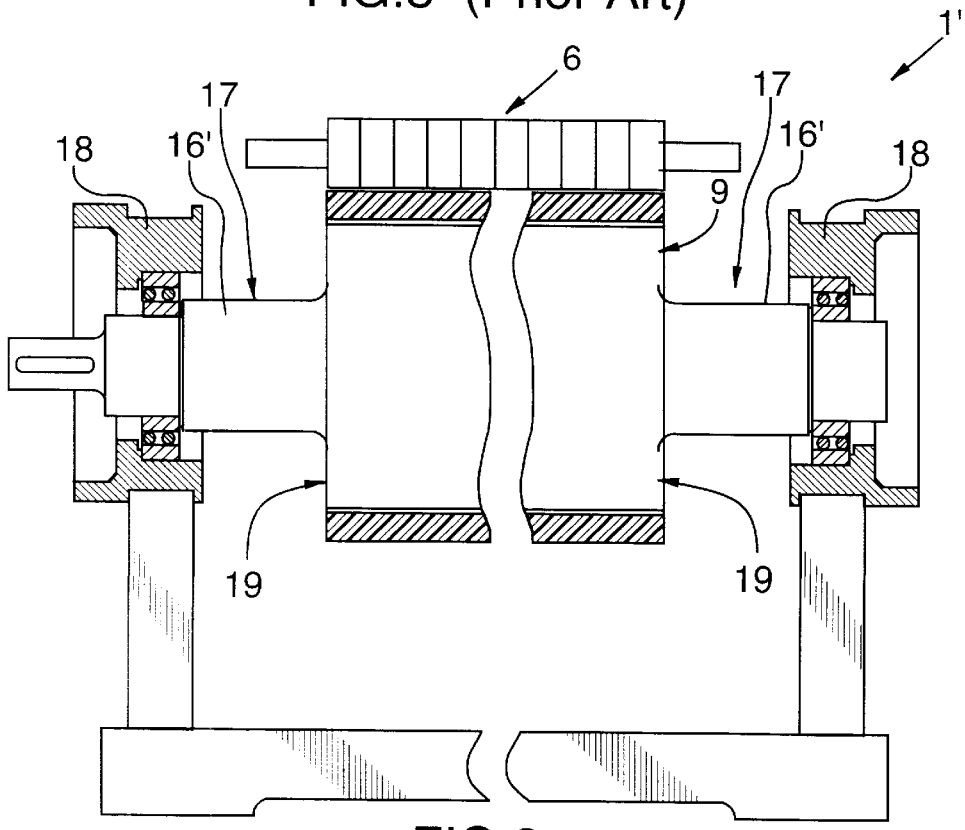
FIG. 9 is a schematic partially sectioned side view of a hide splitting machine according to the invention.
Figure 11:
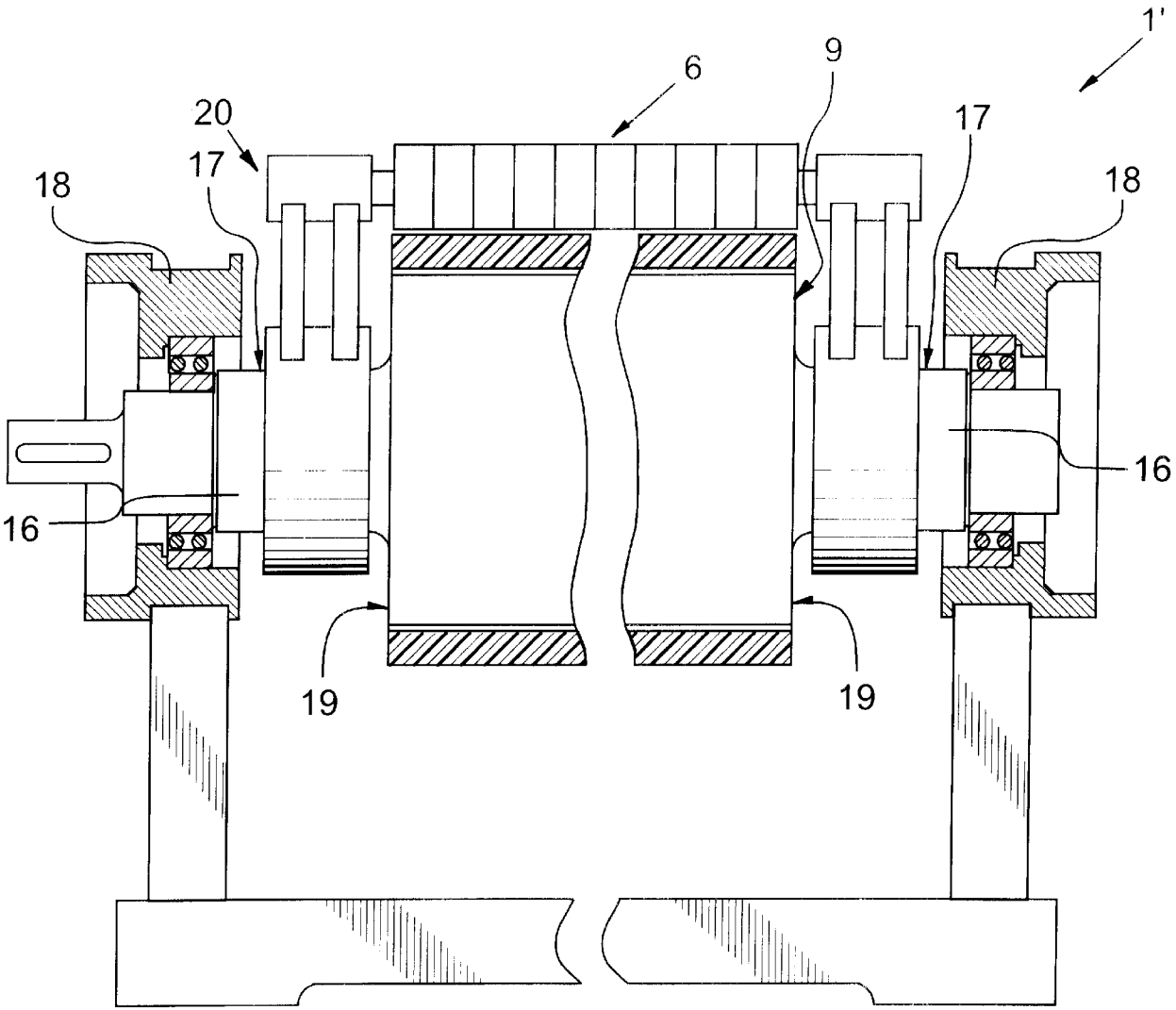
FIG. 11 is a schematic partially sectioned side view of a rubber roller on the hide splitting machine, with a ring roller mounted onto the pivot arms according to the invention.
Figure 12A:
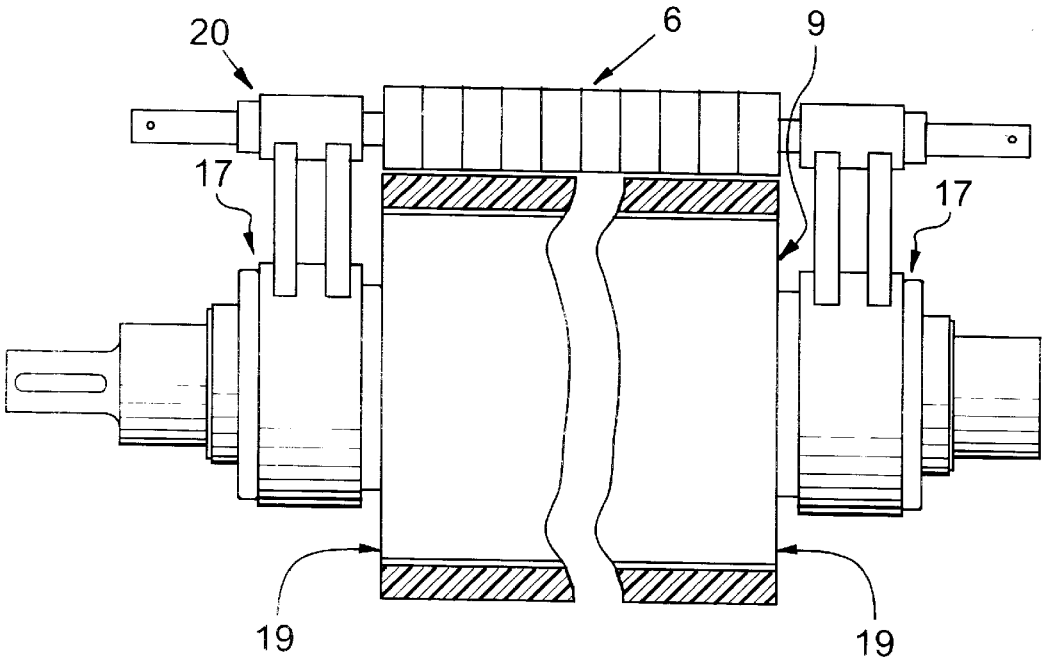
FIG. 12A is a schematic partially sectioned side view of a rubber roller on the hide splitting machine, with a ring roller mounted onto the pivot arms according to a further embodiment of the invention the invention.

A rubber roller 9 commonly installed in a splitting machine 1 has rough surfaced solid steel journals 16 (see FIG. 7) at each end assembled with bearings and housings. In the invention, as shown in FIG. 9, two modified solid steel journals 16' at each end of the rubber roller 9 are used. The modified solid steel journals include material between the edge 19 of the rubber roller face and bearings 18 situated in splitting machine side frame, this extra material is designated 17 in FIG. 9. The solid steel journals are preferably modified via lathe turning and smooth polishing to accommodate rubber roller pivot arms 20, as shown in FIG. 10B. Shown in FIG. 10A, the rubber roller pivot arms 20 are constructed so as to 'slide fit' onto the modified solid steel journals 17 at each end of the rubber roller 9, as shown in FIGS. 10B, 11 and 12A/B. Advantageously, a bushing 21, for example a bronze bushing 'press fit' into each rubber roller pivot arm, facilitates this 'slide fit' of the pivot arms onto the modified solid steel journals at each end of the rubber roller. The bushings 'press fit' into each rubber roller pivot arm also facilitate free rotation of the rubber roller pivot arms on the modified solid steel journals.

Figure 12B:
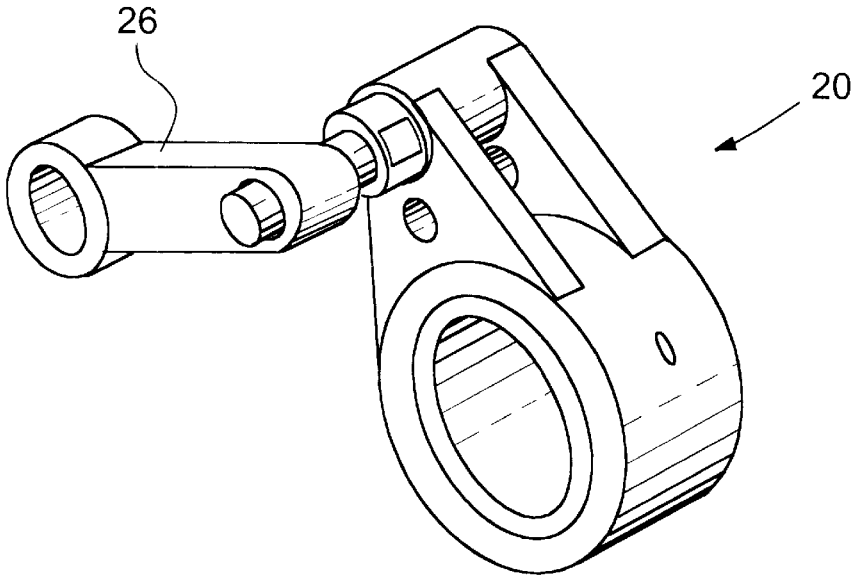
FIG. 12B is a schematic perspective side view of the pivot arm according to the further embodiment of the invention.
Figure 13:
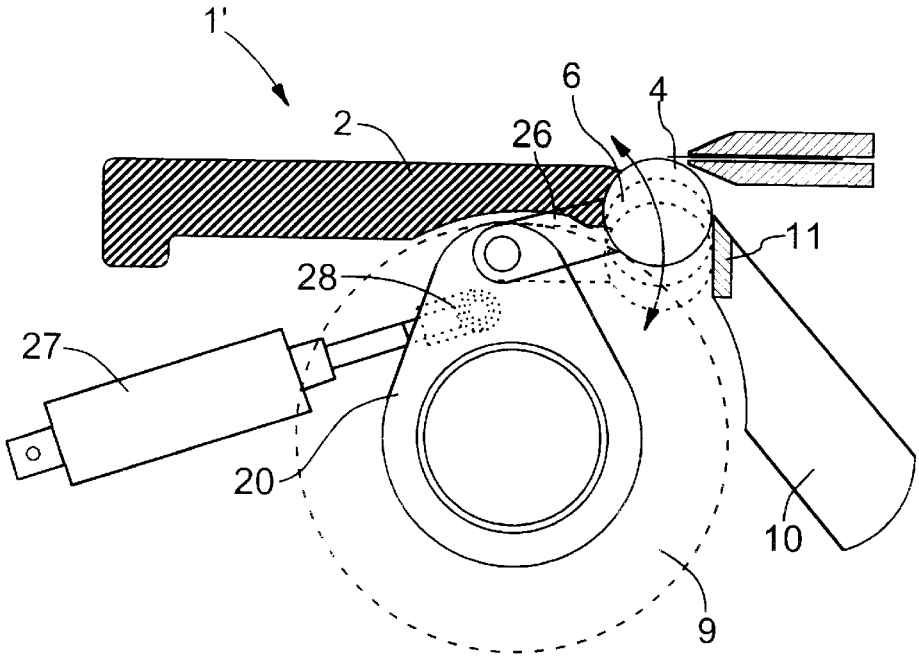
FIG. 13 is a schematic partially sectioned end view of a rubber roller on the hide splitting machine, with a ring roller mounted onto the pivot arms according to the invention, showing the movement possible for the ring roller when mounted onto swivel arms according to the further embodiment of the invention.

The rubber roller pivot arms have a large end 25, housing the bushing 21, one or more extensions 22 attached to the large end and having a distal end 23, which holds a hinge pin 24. The pivot arms 20 are designed to provide a permanent link between the rubber roller 9 and ring roller swivel arms 26 (FIG. 12B). The ring roller swivel arms 26 are designed to allow compression of the ring roller into the rubber roller. Being located below heavy pelts, the ring roller is subjected to large amounts of localized working pressure. The rubber roller 9, by virtue of its elasticity, compensates for the differences in pelt thickness by allowing the ring roller, attached to ring roller swivel arms, to deviate from the straight line of its rotation axis, as shown in FIG. 13.

Figure 10A:
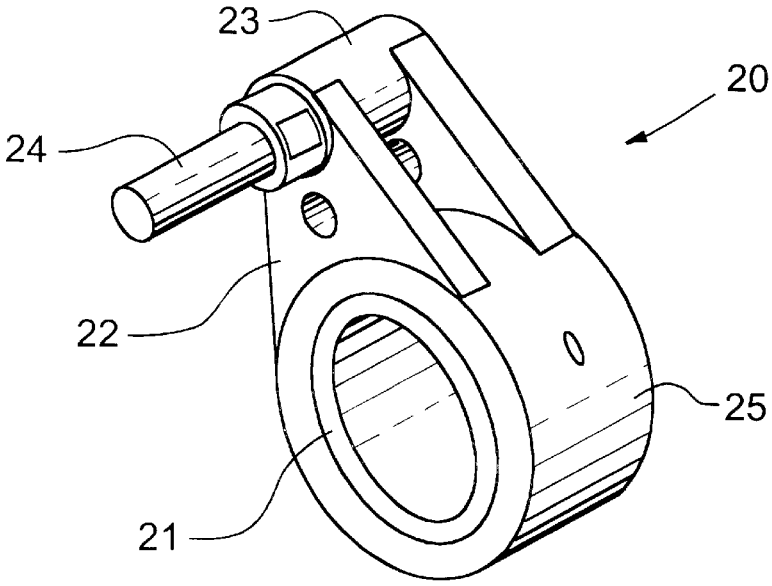
FIG. 10A is a schematic perspective side view of a pivot arm according to the invention.
Figure 10B:
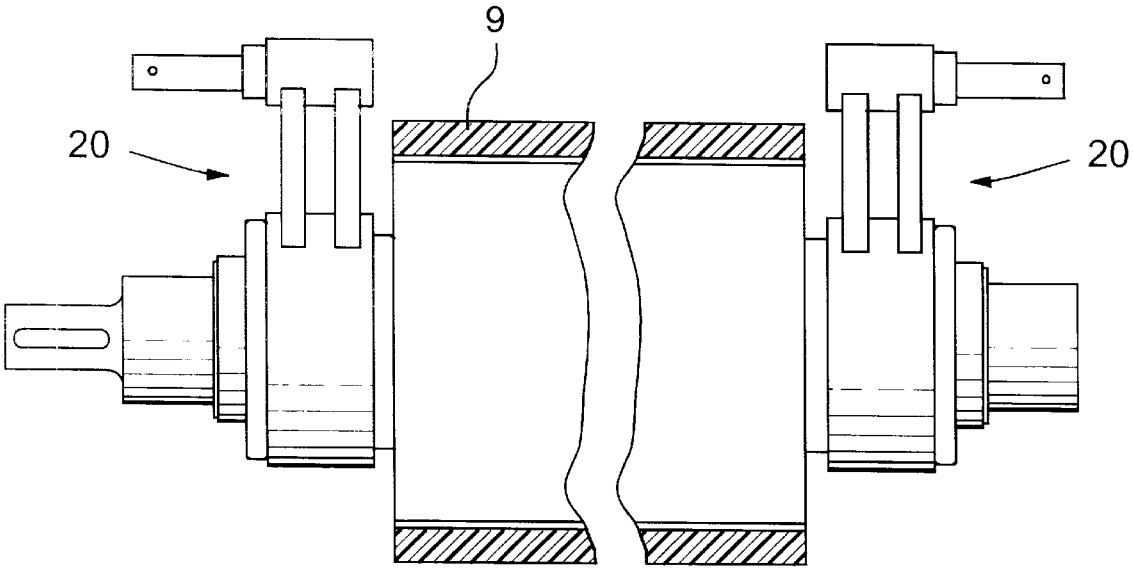
FIG. 10B is a schematic partially sectioned side view of a rubber roller having pivot arms according to the invention.
Figure 14:
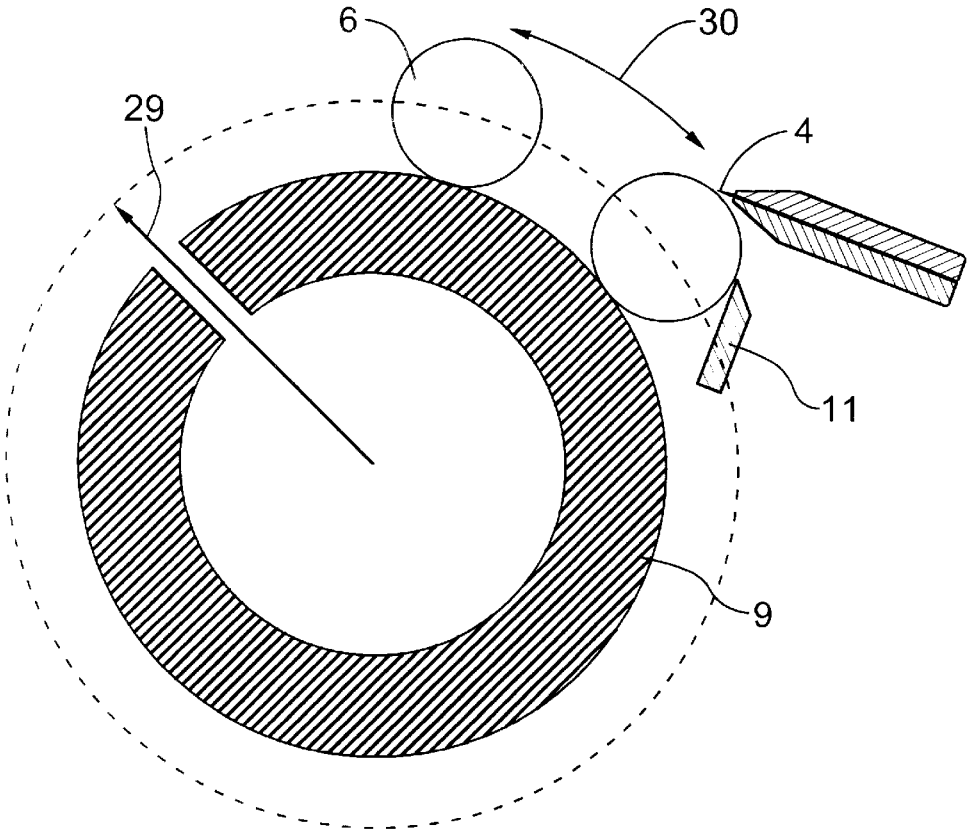
FIG. 14 is a schematic partially sectioned end view of a rubber roller, ring roller, band knife and ring jaw insert, showing the relative movement between the ring roller mounted onto the pivot arms and the rubber roller.
Figure 15:
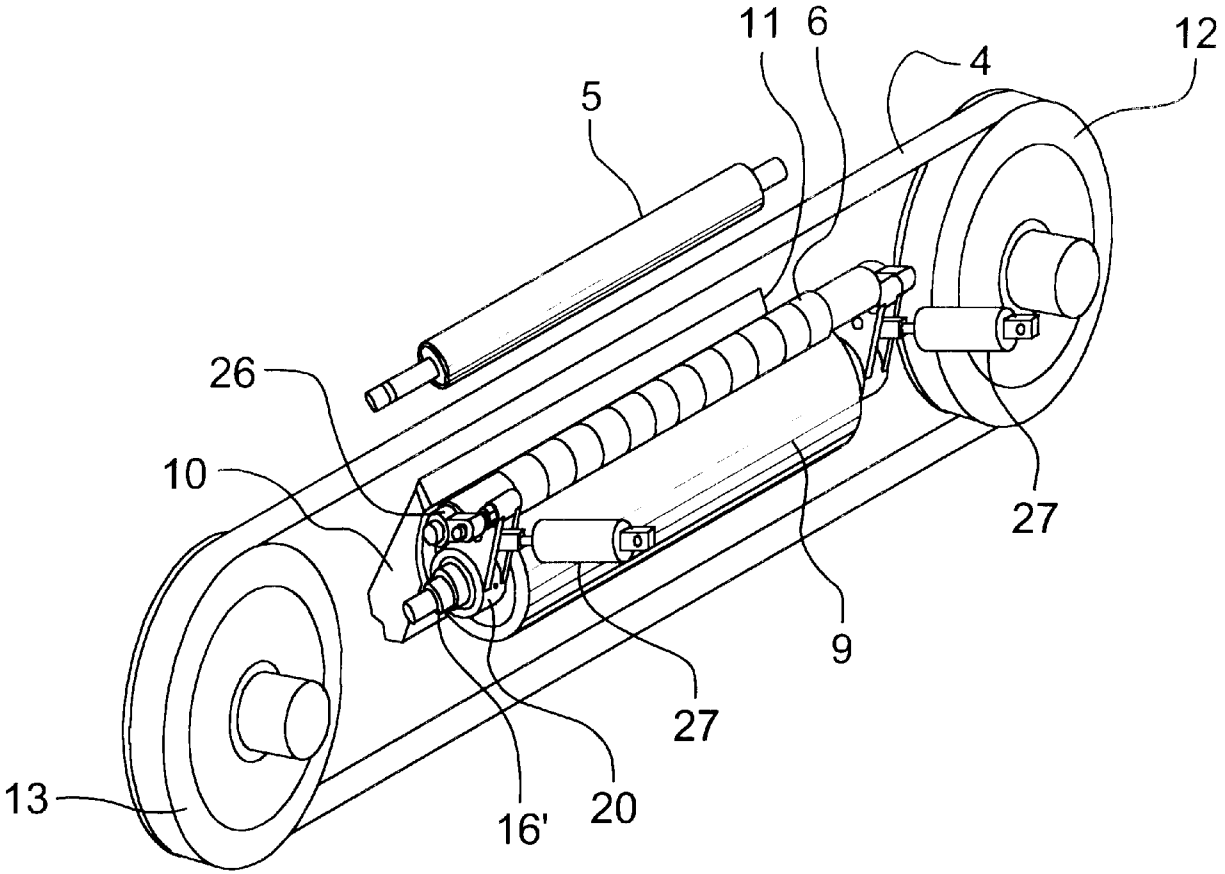
FIG. 15 is a schematic perspective side view of a rubber roller on the hide splitting machine, with a ring roller mounted onto the pivot arms according to the invention.

Rubber roller pivot arms 20 and ring roller swivel arms 26 are connected via the hinge pin 24 (FIG. 10A). The ring roller 6, connected by rotating couplings (not shown) with each ring roller swivel arm 26, is retracted automatically via automatic or manual activation of clevis mount linear actuators 27, as shown in FIG. 13, linked to each rubber roller pivot arm 20 by a slotted rod clevis 28. During automatic retraction the ring roller constantly rests on the rubber roller surface because the swivel arms, attached by the not shown rotating couplings to each end of the ring roller, are designed to allow the distance 29 between the rubber roller center and ring roller center to remain constant, as shown in FIG. 14. Deflection and/or distortion of the ring roller assembly rod is prevented because the ring roller travel 30 is the circumference of the rubber roller and away from the ring jaw insert edge. The automatic retraction of the ring roller, as shown in FIG. 15, facilitates access to the ring jaw insert edge for removal of debris.

Figure 16:
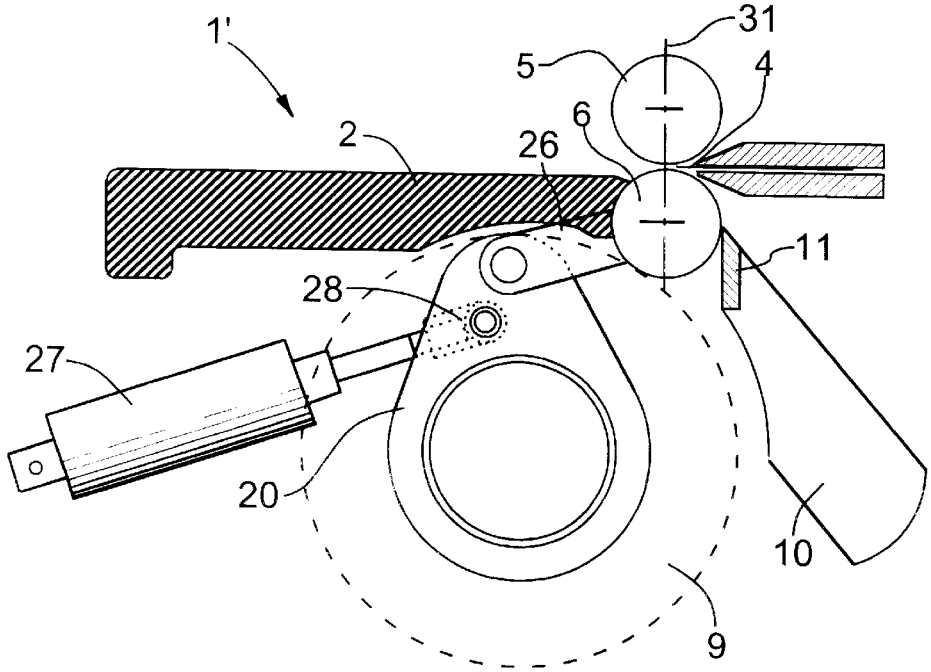
FIG. 16 is a schematic partially sectioned end view of a rubber roller on the hide splitting machine, with a ring roller mounted onto the pivot arms according to the invention.

Splitting machine operators manually clean the ring jaw insert edge and then automatically or manually reactivate the linear actuators 27 linked to each rubber roller pivot arm 20. Since the ring roller swivel arms 26 are designed to compensate for differences in rubber roller 9 and ring roller 6 diameters, the ring roller connected to the retraction system travels the circumference of the rubber roller until the ring roller moves against the ring jaw insert 11 edge and into centerline 31 position with the gauge roller, as shown in FIG. 16. During automatic transport and return of the ring roller into centerline position with the gauge roller, the ring roller rests on the rubber roller surface since the distance between the rubber roller center and ring roller center remains constant, as described for FIG. 14.

Each slotted rod clevis 28, linking each clevis mount linear actuators 27 to each rubber roller pivot arm 20, is designed to allow the ring roller to rest freely on the rubber roller surface against the ring jaw insert when the ring roller is automatically transported from retracted position into centerline position with the gauge roller. The ring roller rests freely on the rubber roller surface against the ring jaw insert because the slotted rod clevis compensates for changes in rubber roller diameter and ring roller diameter caused by normal splitting machine operation, differences in set height of ring roller with respect to the ring jaw insert edge, and ring roller setup error with respect to automatic advancement of the ring roller into working position against the ring jaw insert edge.

Therefore, the automatic retraction system for the ring roller eliminates manual removal and reinstallation of the ring roller.

Accordingly, several objects and advantages of the invention are as follows:

The modification via lathe turning and smooth polishing of two solid steel journals at each end of the existing rubber roller installed in the splitting machine.

Two unique bushings, made from hollow bearing bronze material, machined to 'press fit' in rubber roller pivot arm housing and 'slide fit' on modified solid steel journals.

Two unique rubber roller pivot arms, made from stainless steel or other suitable material, machined with housing for 'press fit' bushing, are installed on the two modified solid steel journals, one at each end of the existing rubber roller.

M20×1.5 hinge pin Ø16 mm, made from smooth polished stainless steel or other suitable material, machined for 'slide fit' rubber roller pivot arm(s), is threaded and wrench tightened onto rubber roller pivot arm.

A unique ring roller swivel arm(s), made from stainless steel or other suitable material, is attached to rubber roller pivot arm via 'slide fit' onto M20×1.5 hinge pin Ø16 mm.

Two commercially available linear actuators, each one connected via 'slide fit' slotted rod clevis between the two uprights of each rubber roller pivot arm, are activated manually or automatically to initiate automatic retraction or travel of the ring roller along the circumference of the rubber roller.

Slotted rod clevis, made from stainless steel or other suitable material, machined to 'slide fit' between uprights of rubber roller pivot arm for connection to rubber roller pivot arm by swivel pin Ø12 mm.

Swivel pin Ø12 mm, made from stainless steel or other suitable material, machined to 'slide fit' into connecting holes for rubber roller pivot arm and slotted rod clevis.

Figure 8:
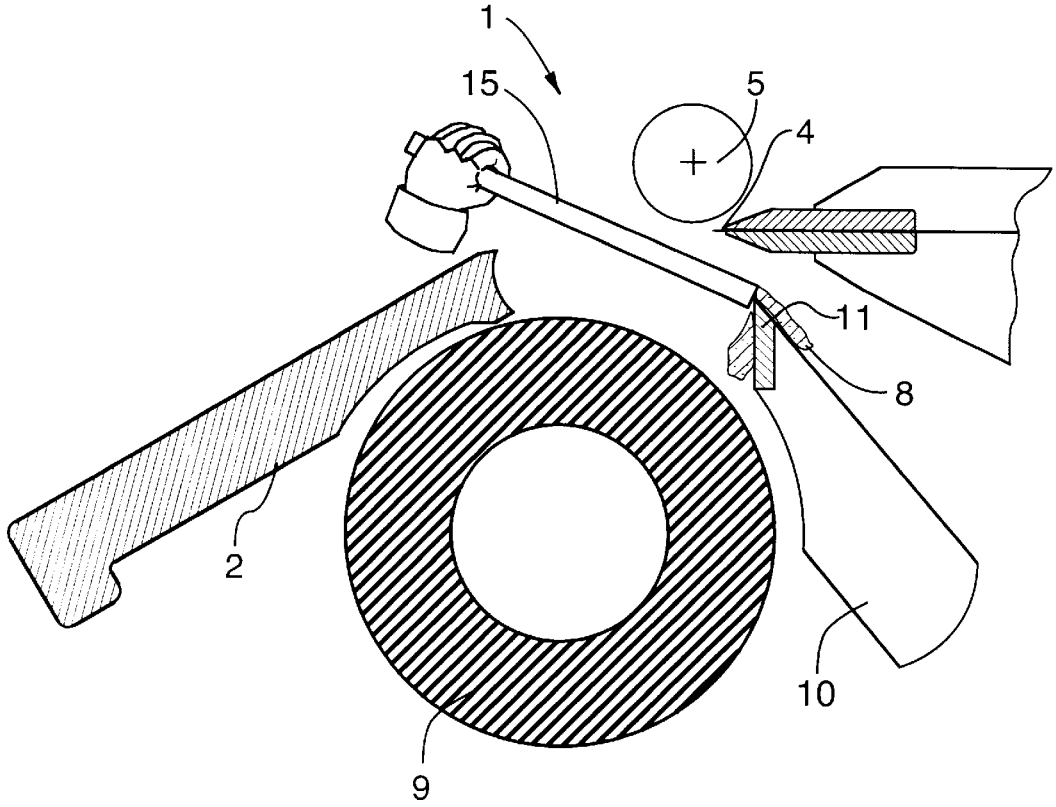
FIG.8 (Prior Art)
FIG. 8 is a schematic partially sectioned end view of a hide splitting machine according to Prior Art, showing manual cleaning of the exposed ring jaw insert edge.

Automatic retraction and travel of the ring roller along the circumference of the rubber roller away from the ring jaw insert edge (FIG. 13) for the purpose of eliminating manual removal of the ring roller prior to manual cleansing of the ring jaw insert edge (FIG. 8).

Automatic retraction and travel of the ring roller along the circumference of the rubber roller minimizes risk of personal injury as the hands and fingers of machine operator(s) do not come into close contact with razor sharp traveling band knife.

Automatic retraction and travel of the ring roller along the circumference of the rubber roller away from the ring jaw insert edge (FIG. 13) for the purpose of facilitating access to the ring jaw insert edge for manual removal of debris (FIG. 8).

Automatic retraction and travel of the ring roller along the circumference of the rubber roller minimizes cleaning time of the ring jaw insert edge and thereby allows for optimum frequency of debris removal from ring jaw insert edge.

Automatic transport and travel of the ring roller along the circumference of the rubber roller into centerline position with the gauge roller (FIG. 15) for the purpose of eliminating manual reinstallation of the ring roller subsequent to manual cleansing of the ring jaw insert edge.

Automatic retraction and travel of the ring roller along the circumference of the rubber roller minimizes the possibility of ring roller mechanical damage previously caused by improper manual handling of the ring roller during manual removal and/or reinstallation of the ring roller.

Automatic retraction and travel of the ring roller along the circumference of the rubber roller minimizes machine operator's required level of technical expertise with respect to creating easy and safe access to the ring jaw insert edge for manual removal of debris.

Further objects and advantages of the invention will become apparent from a consideration of the drawings and ensuing description of the invention.

The invention comprises a mechanism that can automatically retract or draw back the ring roller from the ring jaw insert edge and automatically move or transport the ring roller into proper working position against the ring jaw insert edge.

The ring roller is automatically drawn back a sufficient, preset distance of 75 mm, plus or minus 20 per cent, from the ring jaw insert edge so that grease, fat and/or flesh particles fixated to or hanging on the ring jaw insert edge can be quickly, easily and effectively removed from the ring jaw insert edge. Following manual removal of grease, fat and/or flesh particles from the ring jaw insert edge, the ring roller is automatically returned into proper working position against the ring jaw insert edge and into a center line point with the gauge roller.

Figure 17:
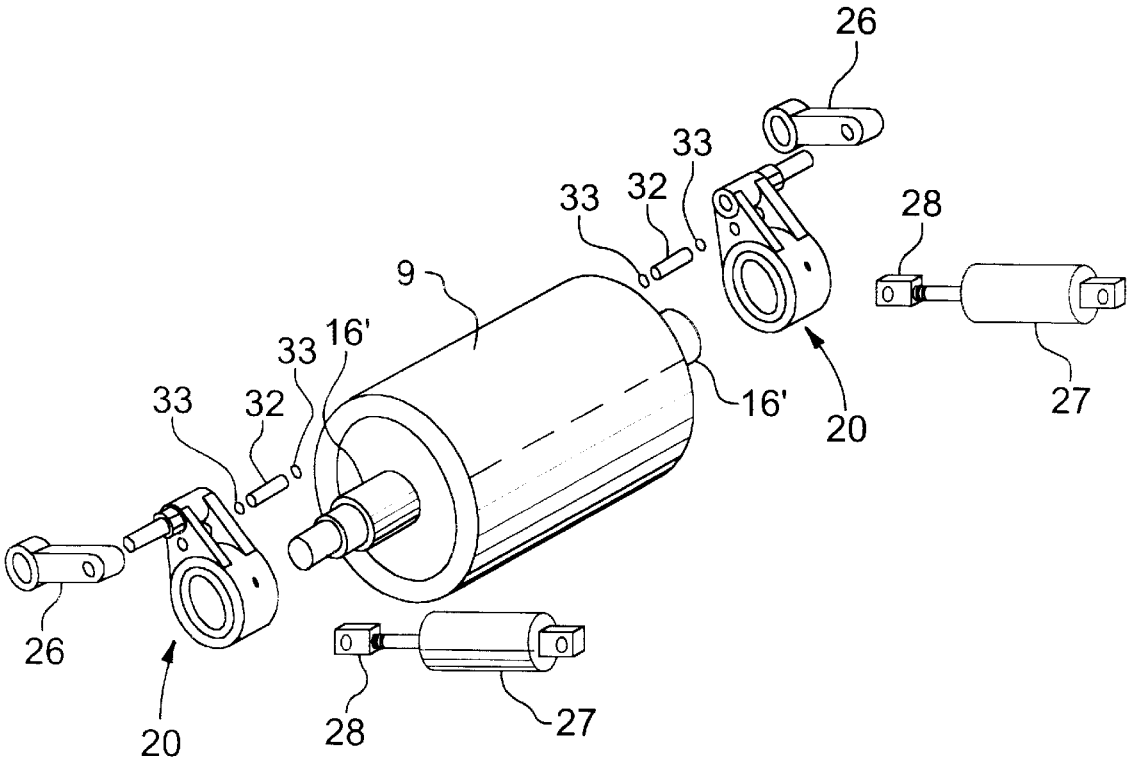
FIG. 17 is a schematic exploded perspective side view of a rubber roller on the hide splitting machine, with pivot arms according to the invention.

The invention includes two modified solid steel journals 16', one journal at each end of the rubber roller, as shown in FIG. 17. The modified solid steel journals include a material length preferably seventy millimeters plus or minus thirty percent between the edge of the rubber roller face and splitting machine side frame. Each journal is advantageously lathe turned smooth and polished to a diameter and surface finish that facilitates slide fitting of the bronze bushing 21, 'press fit' into the corresponding rubber roller pivot arm 20, onto the modified journal. The bronze bushing 'press fit' into each rubber roller pivot arm ensures smooth rotation of each rubber roller pivot arm on the modified solid steel journals. The rubber roller pivot arms are attached by preferably smooth polished hinge pins 24, advantageously having a diameter of around 16 mm, to corresponding ring roller swivel arms 26. Each ring roller swivel arm 'slide fits' and rotates on the corresponding smooth hinge pin. Therefore, the ring roller swivel arms, attached to each end to the ring roller, allow upward and downward movement of the ring roller to compensate for variations in hide substance during splitting.

A commercially available clevis mount linear actuator 27, is connected via 'slide fit' slotted rod clevis 28, advantageously between the extensions 22 of each rubber roller pivot arm 20. Each slotted rod clevis is secured via 'a slide fit' swivel pin 32, advantageously having a diameter of around 12 mm into proper working position between the pivot arm extensions. Preferably, two external snap rings 33 hold each swivel pin in working position. The two clevis mount linear actuators can be, for example, pneumatic, hydraulic or solenoid cylinders that are activated manually or automatically to initiate automatic retraction or travel of the ring roller along the circumference of the rubber roller.

When the ring roller is automatically retracted from the ring jaw insert edge or moved into proper working position against the ring jaw insert edge, the design of the two ring roller swivel arms is such that the distance between the rubber roller center and the ring roller center remains substantially constant. Therefore, the ring roller can travel along the circumference of the rubber roller, with rubber roller support for the entire ring roller working width preventing physical distortion of the ring roller.

When the ring roller is automatically retracted from the ring jaw insert edge, sufficient space is created between the ring roller and the ring jaw insert edge to facilitate safe and quick manual cleaning of the ring jaw insert edge.

When the ring roller is automatically moved against the ring jaw insert edge, the slotted rod clevis is so designed to allow proper positioning of the ring roller into a preset position with the gauge roller. The slotted rod clevis provides compensation for any deviation in splitting machine setup, dimensional differences and/or normal wear of the rubber roller, ring roller and/or ring jaw inserts.

Therefore, the ring roller does not have to be removed manually from the splitting machine prior to manual (or possibly automatic) cleaning of the ring jaw insert edge, nor does the ring roller have to be reinstalled manually in the splitting machine upon completion of manual cleaning of the ring jaw insert edge.

It should be clearly understood that it is not intended that the invention be limited to the specific preferred embodiments described above. Thus, there will be many variations which will be apparent to those who are knowledgeable in the field, and such variations are considered to be within the scope of the invention as defined by the following claims. For example, the function of the pivot arms, according to the invention, is to provide an arcuate travel path for the ring roller, when the ring roller is removed from the jaw insert. A technical equivalent would be to use arced slots provided in plates suitably arranged adjacent the ends of the rubber roller. The ends of the ring roller would slide in the slots, to provide the required travel path for the ring roller. This alternative requires some type of guide plates, or similar, to keep the ring roller traveling substantially equidistant length at both ends, but would accomplish the required travel of the ring roller. Any such solution to the travel path problem is incorporated in the following claims.

What is claimed as the invention is:

1. A hide splitting machine comprising:

an in-feed table;

a ring roller;

a ring jaw insert;

a rubber roller, to support said ring roller;

a gauge roller, and a traveling band knife arranged to split hides fed into a gap created between said ring roller and said gauge roller, wherein said ring roller is rotatably held in a first guide means and a second guide means so that said ring roller is movable along an arched path defined by said first guide means and said second guide means, said ring roller being movable in said first guide means and said second guide means using biasing means, so that, when said in-feed table is swung away from the rubber roller, the ring roller is pivotable away from said gauge roller between a working position, in which said ring roller cooperates with said rubber roller and said gauge roller and said ring jaw insert during a hide splitting operation, and a cleaning position, in which said ring roller is pivoted away from said gauge roller and said ring jaw insert and said traveling band knife to provide access to said ring jaw insert for cleaning same.

2. A hide splitting machine as recited in claim 1, wherein said first guide means comprises a first swivel arm anchored at an outer end of a first pivot arm, an inner end of said first pivot arm being coaxially anchored at one end of said rubber roller, and said second guide means comprises a second swivel arm anchored at an outer end of a second pivot arm, an inner end of said second pivot arm being coaxially anchored at an opposite end of said rubber roller.

3. A hide splitting machine as recited in claim 2, wherein said biasing means comprises a first biasing means connected to said first pivot arm, and a second biasing means connected to said second pivot arm.

4. A hide splitting machine as recited in claim 3, wherein said first and second biasing means comprise linear actuators.

5. A hide splitting machine as recited in claim 4, wherein said linear actuators are pneumatic cylinders.

6. A hide splitting machine as recited in claim 4, wherein said linear actuators are hydraulic cylinders.

7. A hide splitting machine as recited in claim 4, wherein said linear actuators are long-throw solenoids.

8. A hide splitting machine as recited in claim 4, wherein said linear actuators are gear-driven actuators.

9. A hide splitting machine as recited in claim 4, wherein said linear actuators are mechanical linkage systems.

10. A hide splitting machine as recited in claim 1, wherein said ring roller is automatically movable.

11. A hide splitting machine as recited in claim 2, wherein said ring roller is automatically movable.

12. A hide splitting machine as recited in claim 3, wherein said ring roller is automatically movable.

13. A hide splitting machine as recited in claim 4, wherein said ring roller is automatically movable.

14. A hide splitting machine as recited in claim 5, wherein said ring roller is automatically movable.

15. A hide splitting machine as recited in claim 6, wherein said ring roller is automatically movable.

16. A hide splitting machine as recited in claim 7, wherein said ring roller is automatically movable.

17. A hide splitting machine as recited in claim 8, wherein said ring roller is automatically movable.

18. A hide splitting machine as recited in claim 9, wherein said ring roller is automatically movable.

* * * * *